US005735010A

United States Patent [19]

Burner et al.

[11] Patent Number: 5,735,010

[45] Date of Patent: Apr. 7, 1998

[54] APPARATUS FOR AUTOMATED CLEANING OF REACTOR PRESSURE VESSEL CLOSURE STUDS

[75] Inventors: James Edgar Burner, Downington; James Cassidy Donohue, Sharon Hill; Bangalore P. Mallikarjuna, Downington, all of Pa.

[73] Assignee: General Electric Company, San Jose, Calif.

[21] Appl. No.: 612,738

[22] Filed: Mar. 8, 1996

[51] Int. Cl.[6] ..... A47L 15/00; B08B 1/00

[52] U.S. Cl. ..... 15/88; 15/104.04

[58] Field of Search ..... 15/77, 88, 88.1, 15/102, 104.04

[56] References Cited

U.S. PATENT DOCUMENTS

| | | | |
|---|---|---|---|
| 4,014,062 | 3/1977 | Scott et al. | 15/104.04 |
| 4,165,549 | 8/1979 | Wennerstrom et al. | 15/88 |
| 4,452,753 | 6/1984 | Wentzell et al. | 376/249 |
| 4,501,044 | 2/1985 | Schulze et al | 15/312 R |
| 4,787,112 | 11/1988 | Gebhardt et al. | 15/77 |

*Primary Examiner*—Ponnathapura Achutamurthy
*Assistant Examiner*—Brett Nelson
*Attorney, Agent, or Firm*—James E. McGinness; Dennis M. Flaherty

[57] ABSTRACT

An apparatus for cleaning of a reactor pressure vessel head closure stud. The surface of the stud is cleaned by power vacuum brushing. The stud is hung vertically in a cabinet which supports a vertically elevatable spinner housing. The stud is cleaned in a single process using a rotating wire brush system which is rotatably mounted in the spinner housing and has a central opening for passage of the stud. A plurality of wire bushes are arranged in a circular array surrounding the stud. While the wire brushes are rotating in contact with the stud external surface, the spinner housing and wire brush assembly are displaced vertically by an elevator so that the rotating brushes travel along the full length of the stud. The rotating brushes remove accumulated material on the stud surface. The resulting contaminated debris is contained in a volume enclosed by a brush canister and a bellows. The bellows expands or contracts as the elevator travels. The contaminated debris is drawn into a high-efficiency particulate absolute filter by a vacuum pump.

18 Claims, 5 Drawing Sheets

APPARATUS FOR AUTOMATED CLEANING OF REACTOR PRESSURE VESSEL CLOSURE STUDS

FIELD OF THE INVENTION

This invention relates to systems which are useful in the servicing and maintenance of a nuclear reactor. In particular, the invention relates to systems which can be used to clean nuclear reactor components.

BACKGROUND OF THE INVENTION

During operation of a boiling water reactor (BWR), the reactor pressure vessel is closed by a head closure which is secured to the upper flange of the vessel by closure studs and associated stud nuts. In order to perform any maintenance, refueling, repair, inspection or other operation inside the RPV, the head closure must be removed to gain access to the vessel interior. All of the RPV head closure nuts must be removed to permit removal of the RPV head.

In order to reduce critical path schedule time for reactor disassembly and inspections, some BWR operators remove all of the RPV head closure studs with the head closure. Non-destructive examination is usually required for all removed studs. Prior to non-destructive examination, the surfaces of the RPV head closure studs must be adequately cleaned of all debris and contamination.

To clean the stud surfaces, BWR operators presently employ equipment and procedures that require time-consuming manual manipulation with inherent personnel risks and that create considerable waste. The current method of cleaning the RPV head closure studs is with a hand-held wire brush, solvent and rags. This procedure is tiring to the personnel and time consuming. In addition, it produces extensive contaminated material wastes. As a consequence, the cleaning procedure must be carried out in a controlled area. There is a need for a system which provides fast, automated, powered cleaning of the surface of a RPV closure stud with minimum handling by the operator, while controlling contamination and minimizing waste generation.

SUMMARY OF THE INVENTION

The present invention is an apparatus for performing automatic cleaning of an RPV head closure stud in preparation for non-destructive examination. The surface of the stud is cleaned by power vacuum brushing. The stud is hung vertically in a cabinet which supports a vertically displaceable spinner housing. The stud is cleaned in a single process using a rotating wire brush system which is rotatably mounted to the spinner housing and has a central opening for passage of the stud. A plurality of wire bushes are arranged in a circular array surrounding the stud. While the wire brushes are rotating in contact with the stud external surface, the spinner housing and rotating wire brush assembly are displaced vertically so that the rotating brushes travel along the full length of the stud.

The rotating brushes remove the layer of accumulated material on the stud surface by abrasion. The resulting contaminated debris is contained in a volume enclosed by a brush canister and a bellows. A conduit has one end in flow communication with the volume inside the bellows and another end in flow communication with a vacuum pump. When the pump is activated during the cleaning sequence, the contaminated debris is drawn out of the bellows and into a high-efficiency particulate absolute filter, thereby eliminating the possibility of airborne contamination.

The stud cleaner in accordance with the preferred embodiment comprises an air-powered motor-driven brush canister and an air-powered motor-driven elevator, housed in a freestanding cabinet. The stud cleaner brush canister can be rotated in either a clockwise or a counterclockwise direction. During an upward cleaning cycle, the elevator moves the rotating canister upward to the top of the stud, where an upper limit switch is tripped. When the limit switch is tripped, both the brush rotating direction and the elevator direction are reversed, initiating a downward cleaning cycle. When the canister reaches the bottom of the stud, a lower limit switch is tripped, which cuts off the supply of compressed air to the elevator and brush canister motors. The cleaning cycle is then complete.

In accordance with the preferred embodiment, the stud cleaning system comprises: a support frame for hanging the stud in a vertical position; an elevator system comprising a spinner housing having an opening through which the stud passes and an elevator drive mechanism for displacing the spinner housing along the axis of the stud; a brush assembly rotatably mounted to the spinner housing for rotation about the stud axis and having an opening through which the stud passes; and a brush rotation drive mechanism for rotating the brush assembly about the stud axis. The stud cleaning system further comprises a brush canister which surrounds the wire brush array and the portion of the stud being cleaned; a bellows having one end coupled to the spinner housing and another end coupled to the support frame, the bellows surrounding the portion of the stud below the spinner housing; a conduit having one end in flow communication with an enclosed volume formed in part by the brush canister and the bellows, and another end in flow communication with a vacuum pump; and a filter arranged between the conduit and the vacuum pump for removing contaminated debris from the air sucked from the enclosed volume by the vacuum pump.

The benefits of the stud cleaner in accordance with the present invention include the following: (1) automatic operation; (2) elimination of manual cleaning; (3) reduction in exposure of personnel to contaminated material; (4) reduced process time; (5) contamination debris capture; and (6) reduction of contaminated waste.

DETAILED DESCRIPTION OF THE PREFERRED EMBODIMENT

In accordance with the method of the invention, a reactor pressure vessel head closure stud is hung in a vertical position. A plurality of wire brushes are placed in contact with the external surface of the stud. The wire brushes are orbited around the stud external surface so that the wire bristles remains in contact with the stud external surface. At the same time, the elevation of the wire brushes is continuously changed. During a first phase in the cleaning cycle, the wire brushes orbit in a clockwise direction and ascend, so that each bristle follows an upwardly spiraling helical path along the stud external surface. During a second phase in the cleaning cycle, the wire brushes orbit in a counterclockwise direction and descend, so that each bristle follows a downwardly spiraling helical path along the stud external surface. While the bristles clean the stud external surface, a substantially enclosed volume is maintained around the wire brushes and the portions of the stud at and below the elevation of the wire brushes. The ambient atmosphere inside this enclosed volume is continuously sucked out to remove contaminated debris which has been separated from the stud external surface by the wire brushing operation.

Figure 1:
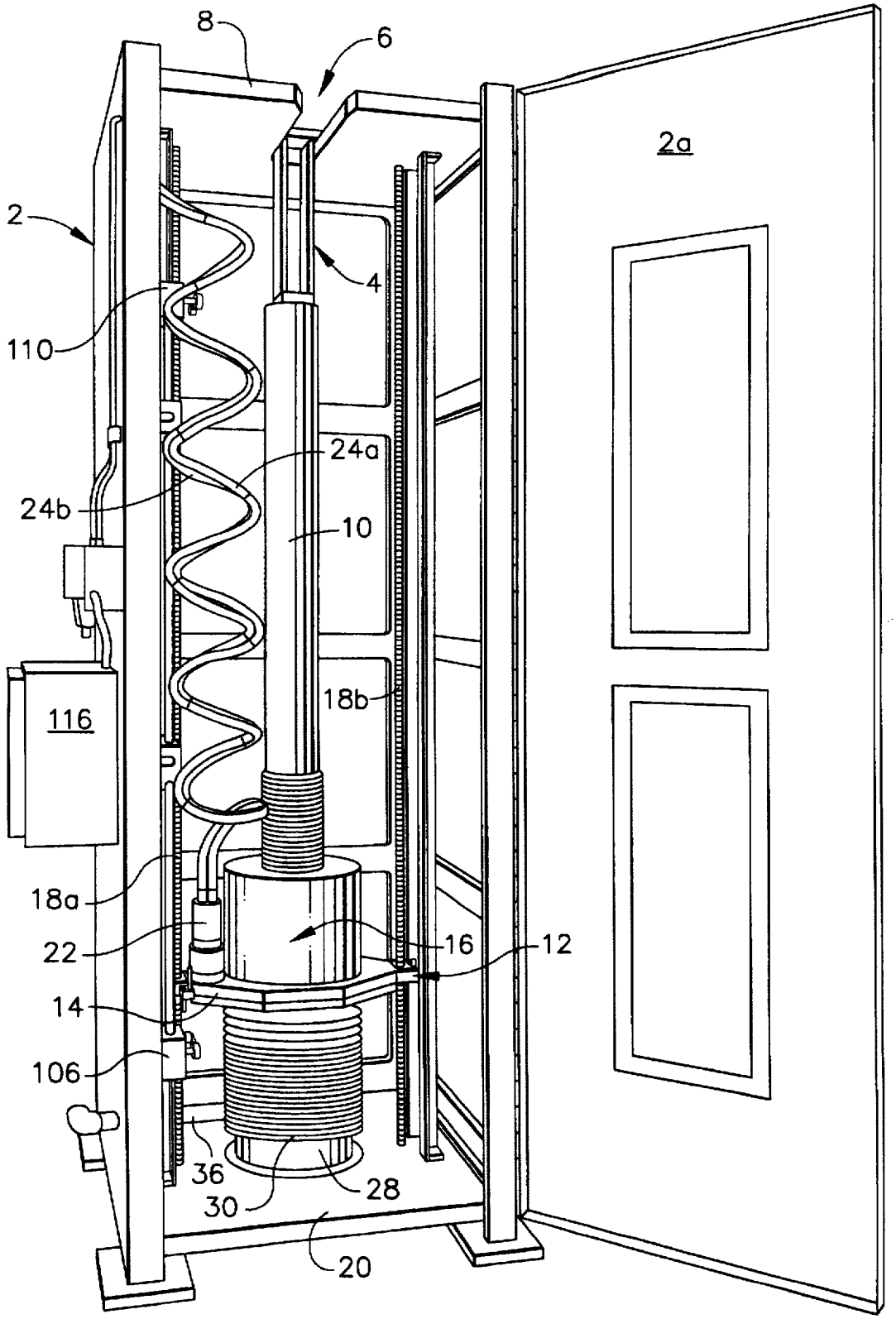
FIG. 1 is a schematic diagram showing an isometric view of the stud cleaning assembly in accordance with the preferred embodiment of the present invention.

Referring to FIG. 1, the major components of the stud cleaner are as follows: a cabinet enclosure 2; a stud hanger 4 which seats in a slot 6 formed in the top plate 8 of the cabinet and from which the stud 10 is hung; an elevator system 12 installed inside the cabinet and comprising a spinner housing 14 which is vertically displaceable; and a wire brush assembly 16 rotatably mounted to the spinner housing 14. The spinner housing 14 and the wire brush assembly 16 each have an opening for the passage of the stud.

The spinner housing is raised or lowered by means of a pair of parallel vertical lead screws 18*a* and 18*b*. Each lead screw has one end rotatably mounted in the top plate 8 and the other end rotatably mounted in the bottom plate 20 of the cabinet 2 by means of conventional bearings 84 (seen in FIGS. 2 and 4). The lead screws are driven to rotate in unison by an air motor 21 (see FIG. 4) mounted under top plate 8. The wire brush assembly 16 is driven to rotate by an air motor 22 which is mounted on the spinner housing 14. The inlet and outlet ports of air motor 22 are connected to one end of respective coiled air hoses 24*a* and 24*b* (see FIG. 1).

When the cleaning operation is started, the wire brush assembly 16 is rotated clockwise as the spinner housing 14 ascends. The rotating brushes clean the stud surface by abrasion. When the spinner housing reaches an upper limit switch 110, the supply of compressed air to the motors 21 and 22 is cutoff. Ascent of the spinner housing 14 and rotation of the wire brush assembly 16 are stopped. Then the supply of compressed air to the air motors is resumed, with the directions of elevator travel and brush rotation reversed. The spinner housing descends until a lower limit switch 106 is tripped and the supply of compressed air is again cutoff.

In accordance with the preferred embodiment of the invention, a receiving tube 28 (see FIG. 2) is attached to the bottom plate 20 of cabinet 2. A bellows 30 extends from the receiving tube 28 to the spinner housing 14. The bellows alternately expands and contracts during ascent and descent, respectively, of the spinner housing. The debris produced by the stud surface cleaning is captured in a volume enclosed by the wire brush assembly 16, bellows 30 and receiving tube 28. This debris is drawn into a high-efficiency particulate absolute (HEPA) filter 32 by a vacuum pump 34 via a vacuum suction line 36.

The cabinet 2 is a frame assembly having strength and rigidity sufficient to support the weight of the stud. The top plate 8 and bottom plate 20 of cabinet 2 are supported at four corners by four corner uprights 38 (see FIG. 5), which are braced laterally by cross members 40 at five elevations.

Figure 4:
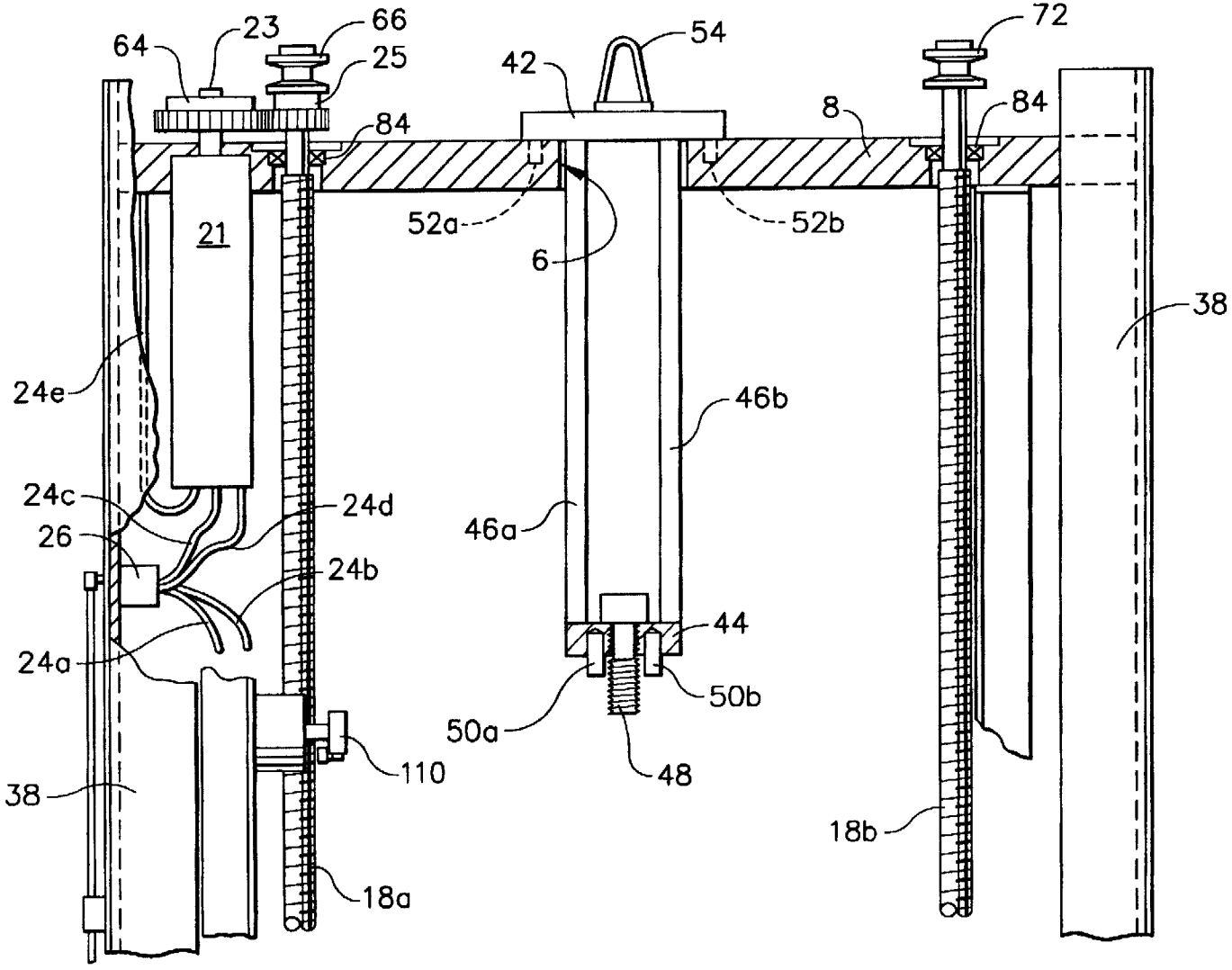
FIG. 4 is a schematic diagram showing the uppermost portion of the stud cleaning assembly in accordance with the preferred embodiment of the invention.

In accordance with the present invention, the stud is hung from a stud hanger 4, shown in detail in FIG. 4. The stud hanger consists of a top plate 42, a bottom plate 44 and a pair of parallel side plates 46*a* and 46*b* connected to the top and bottom plates. The outer surfaces of the side plates are separated by a distance less than the width of slot 6 in the cabinet top plate 8. The stud hanger bottom plate 44 has a threaded bore through which a stud hanger bolt 48 passes. A portion of the stud hanger bolt thread is removed under the bolt head, which allows the stud hanger bolt 48 to thread through the hole in bottom plate 44 and become captured in the bottom plate while still allowing rotation. The threaded portion of the shaft of bolt 48 extends below the bottom plate 44. A pair of dowel pins 50*a* and 50*b* extend parallel to and on opposite sides of the stud hanger bolt 48. These dowel pins slide into form-fitting unthreaded axial bores (not shown) drilled into the top of the stud. The stud hanger is attached to the top of the stud using bolt 48, which is screwed into a threaded axial bore (not shown) drilled in the top of the stud.

A heavy-duty safety hoist ring 54 is attached to the stud hanger top plate 42. To hang the attached stud inside the cabinet 2, the cabinet door 2*a* (see FIG. 1) is opened, and the coupled stud and stud hanger are hoisted and conveyed so that the stud hanger enters the slot 6 (see FIG. 5) in the cabinet top plate 8. The stud hanger top plate 42 has a pair of dowel pins 52*a* and 52*b* which must be aligned with corresponding form-fitting holes in the cabinet top plate 8. As shown in FIG. 4, the stud hanger top plate 42 has a width greater than the width of slot 6 and bears against the cabinet top plate 8. In this manner, the weight of the stud 10 is supported by the cabinet 2. The cabinet members and stud hanger members are arranged so that the longitudinal axis of the hanging stud 10 is coaxial with the axis of rotation of the wire brush assembly 16 and parallel to the axis of translation of the wire brush assembly. After the stud has been hung, the door 2*a* is closed and secured. Interlocks (not shown) will not allow the cleaning system to operate unless the door is securely closed.

Figure 2:
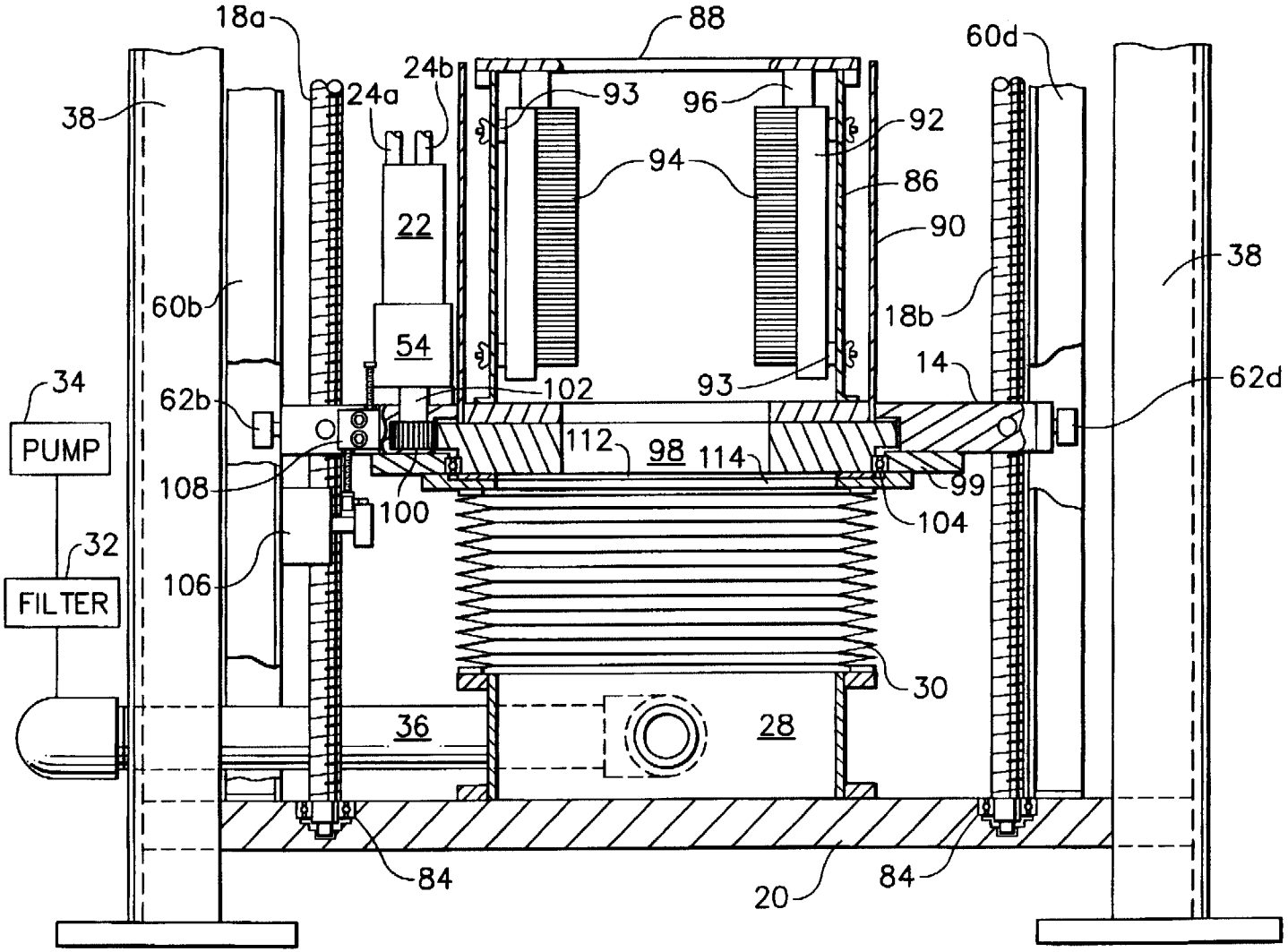
FIG. 2 is a schematic diagram showing the lowermost portion of the stud cleaning assembly in accordance with the preferred embodiment of the invention, with the elevator in the lowermost position.
Figure 3:
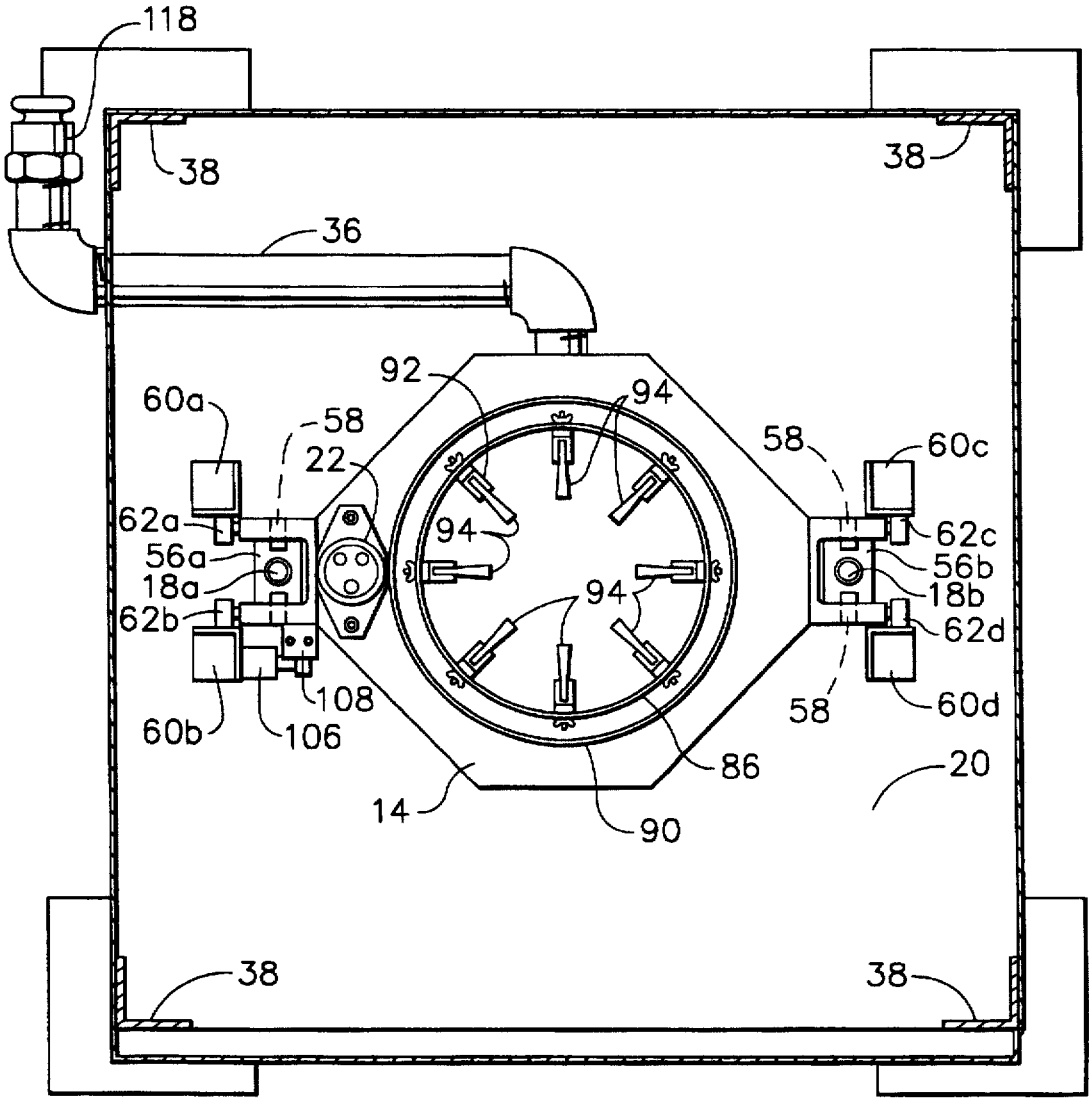
FIG. 3 is a schematic diagram showing a top view of the assembly depicted in FIG. 2.

The elevator 12 will be described in detail with reference to FIGS. 2–5. In accordance with the present invention, the spinner housing 14 serves as the carriage which carries the wire brush assembly and the air motor that drives the wire brush assembly to rotate. As seen in FIG. 3, a pair of nuts 56*a* and 56*b* are "gimbaled", by means of pivot pins 58, to the arms of brackets machined into opposite ends of the spinner housing 14. Nut 56*a* is threadably coupled to lead screw 18*a*; nut 56*b* is threadably coupled to lead screw 18*b*. The gimbal mountings prevent binding of the lead screws during vertical travel.

The respective ends of the spinner housing 14 are displaced in the same direction and at the same travel speed in response to the lead screws 18*a*, 18*b* being rotated in the same direction and at the same rotational speed. For example, in response to clockwise rotation of the lead screws, the spinner housing ascends; in response to counterclockwise rotation of the lead screws, the spinner housing descends. To prevent bending of the lead screws in a direction perpendicular to the plane of the lead screws, vertical travel of the spinner housing is guided and restrained by two pairs of lead screw stiffeners 60*a*–60*d* having opposing planar surfaces. The lead screw stiffeners may take the form of angles. A pair of cam followers 62*a* and 62*b* are rotatably mounted at one end of the spinner housing such that cam follower 62*a* rolls along one surface of lead screw stiffener 60*a* and cam follower 62*b* rolls along the opposing surface of lead screw stiffener 60*b*. Similarly, a pair of cam followers 62c and 62d are rotatably mounted at the other end of the spinner housing and roll along opposing surfaces of lead screw stiffeners 60c and 60d. Abutment of the cam followers against the lead screw stiffeners prevents deflection of the lead screws in a direction perpendicular to the plane of the lead screw axes of rotation.

The elevator drive system further comprises means for rotating both lead screws 18a and 18b in unison in response to activation of the air motor 21. The inlet and outlet ports of air motor 21 are connected to one end of respective air hoses 24c and 24d (see FIG. 4). The other ends of air hoses 24c and 24d are connected to a manifold 26 mounted in the cabinet wall. The air hoses 24a and 24b, which connect to the air motor 22, are also connected to the manifold 26. The manifold 26 is connected to a 100-psig air supply. The manifold incorporates a pair of shuttle valves which are operated by respective solenoids controlled by relays. The relays and solenoids are connected to a 120-volt, 60-Hz single-phase power supply. The shuttle valves direct the compressed airflow to either one port or the other port of the air motors, depending on the desired directions of elevator travel and brush rotation. The compressed airflow to the shuttle valves is in turn controlled by a solenoid-actuated main air valve situated upstream of the shuttle valves. Each air motor 21 and 22 is also connected to one end of an air exhaust line (e.g., line 24e in FIG. 4), the other ends of the air exhaust lines being respectively coupled to air exhaust mufflers 82 (see FIG. 5).

Referring to FIG. 4, the air motor 21 has a drive shaft 23 on the end of which a spur gear 64 is securely mounted. Spur gear 64 meshes with a spur gear 25 which is securely mounted to the upper end of the lead screw 18a. Thus, lead screw 18a is driven to rotate via spur gears 25 and 62.

Figure 5:
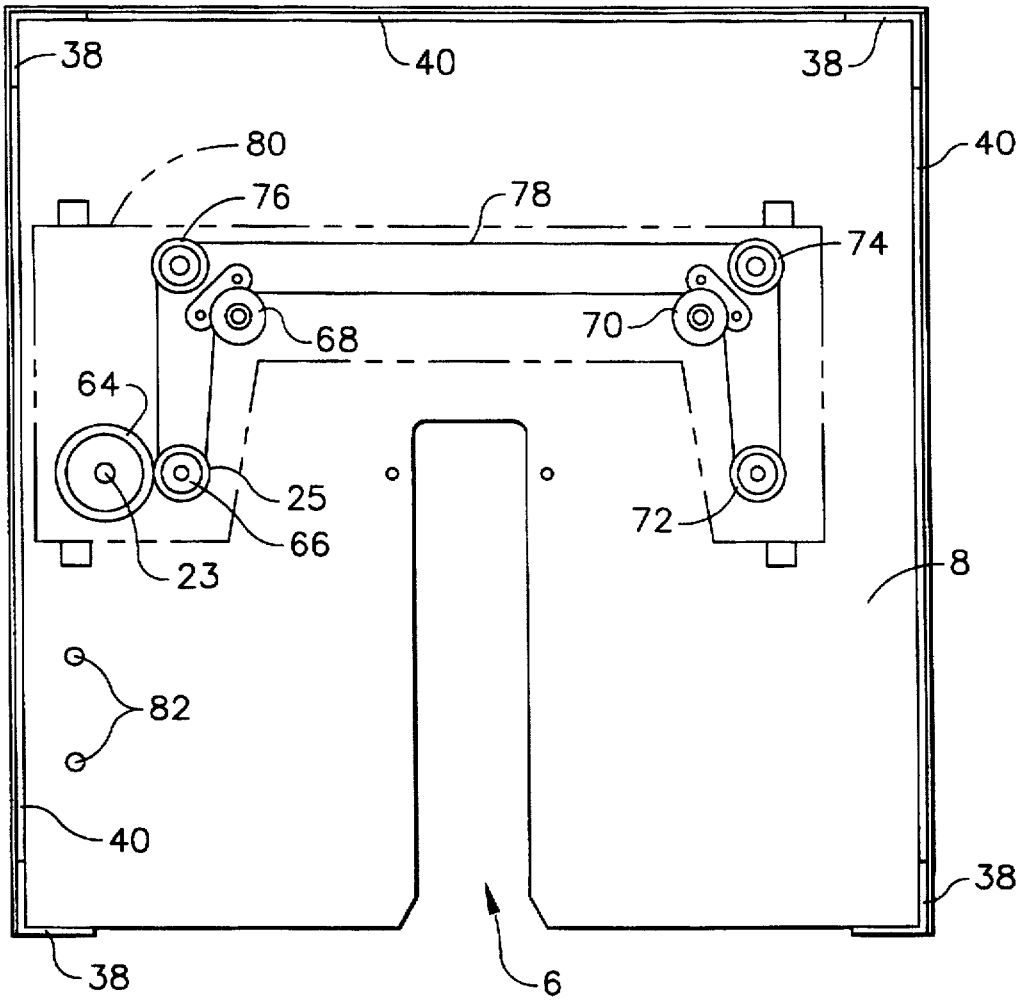
FIG. 5 is a schematic diagram showing a top view of the stud cleaning assembly in accordance with the preferred embodiment of the invention.

Referring to FIG. 5, the second lead screw 18b is driven to rotate at the same speed as the first lead screw by means of a timing belt 78 supported by a set of pulleys, including: a drive pulley 66 mounted on the end of the lead screw 18a; a pair of tensioner pulleys 68 and 70, which maintain a desired tension in the timing belt 78 and direct the path of the timing belt around the slot 6; a drive pulley 72 mounted on the end of the lead screw 18b; and a pair of idler pulleys 74 and 76. The tensioner and idler pulleys are rotatably mounted on the cabinet top plate 8. The timing belt and pulleys are surrounded by a belt guard 80. The timing belt 78 drives the second lead screw 18b and synchronizes it with the first lead screw 18a. The lead screws drive the nut blocks 56a, 56b, which are gimbaled to each side of the spinner housing 14.

The spinner housing 14 acts as an elevator carriage or platform for the wire brush assembly 16 and for the means for driving rotation of the wire brush assembly. The air motor 22 is mounted on spinner housing 14 by means of a motor mounting flange 54, shown in FIG. 2. The air motor 22 has a drive shaft 102, on the end of which a pinion gear 100, contained inside spinner housing 14, is mounted. Pinion gear 100 meshes with a large-diameter spur gear 98 (hereinafter "ring gear") which is rotatably mounted inside the spinner housing 14 by means of a main bearing 104 housed in bearing housing 99. The main bearing is a conventional ball bearing having an inner race coupled to the ring gear by means of an inner race retainer 112 and having an outer race coupled to the bearing housing 99 by an outer race retainer 114. The ring gear 98 is driven to rotate by pinion gear 100 in response to compressed airflow through the air motor 22. Ring gear 98 can rotate in either direction depending on the flow direction.

The wire brush assembly 16 is mounted to the ring gear 98 for rotation therewith. Referring to FIG. 2, assembly 16 comprises a set of eight wire brushes 94 extending generally radially inward and distributed at equal angular intervals around the inner circumference of a rotating brush canister 86. The canister 86 is a circular cylindrical tube with a flange at the bottom for attachment to the ring gear 98. The canister tube has a diameter greater than the outer diameter of the stud, with an annular gap therebetween. The annular gap is covered by a brush canister cover 88, which attaches to the open top of the canister.

Each wire brush comprises a multiplicity of wire bristles which stay in contact with the external surface of the stud during brush canister rotation. The brushes 94 are held in brush brackets 92, which are bolted to the canister and held down by a brush hold-down ring 96 attached to the canister cover 88. The brush brackets 92 are separated from the canister wall by a distance determined by the thickness of brush spacers 93. That distance can be changed to adjust for different stud diameters by installing spacers of different thickness. The canister is surrounded by a brush canister guard 90, which is a concentric circular cylindrical tube.

In accordance with the preferred embodiment of the invention, a lower limit switch 106 (see FIG. 2) is mounted on the lead screw stiffener 60b at a first elevation and an upper limit switch 110 (see FIG. 4) is mounted on the lead screw stiffener 60b at a second elevation above the first elevation. The distance separating the first and second elevation is a function of the length of the stud. Each limit switch has a pivotable trip arm. A limit switch trip bracket 108 is mounted on the side of one of the machined brackets of spinner housing 14, as best seen in FIG. 3. The trip bracket 108 has a pair of vertical threaded bores in which respective trip screws are screwed. One trip screw will bear against and pivot the trip arm of the upper limit switch when the upper limit position is reached; the other trip screw will bear against and pivot the trip arm of the lower limit switch when the lower limit position is reached. The elevator system moves the rotating brush canister upward from the starting position to the top of the stud until the upper limit switch 110 is tripped, which reverses the directions of brush rotation and elevator travel. Thereafter, the rotating brush canister moves downward until the lower limit switch 106 is tripped, at which point the cleaning cycle is complete and the supply of air to motors 21 and 22 is shut off. The elevator travel distance can be adjusted to accommodate the total stud length or any amount of the total stud length to be cleaned. If unusually stubborn deposits are found on the stud, the upward/downward motion can be remotely controlled to allow localized cleaning by means of control buttons in an electric box 116 mounted on the outside of the cabinet.

A further feature of the stud cleaner in accordance with the invention is the ability to capture and draw debris into a HEPA filter system 32. The brush canister 86 with the bellows 30 capture the debris coming off the stud during the brushing action. An upper flange of the bellows is attached to the bearing outer race retainer 114, while a lower flange of the bellows is attached to the receiving tube 28, which is circular cylindrical. The bellows 30 expands when the elevator ascends and contracts when the elevator descends to maintain an enclosed volume between the stud and an enclosure formed by the receiving tube 28, the bellows 30, the brush canister 86 and the brush canister cover 88. The cabinet enclosure 2 provides a restricted volume in which air flow is into the brush canister when air is sucked from the enclosed volume by the vacuum pump 34 (see FIG. 2) via the suction line 36. The HEPA filter is coupled to an adaptor 118 (shown in FIG. 3). When the vacuum pump 34 is running, it creates a negative pressure inside the brush canister which draws debris down through the bellows 30 and into the filter 32, where the debris is collected.

A control panel is located inside the electric box 116 on the outside of the cabinet 2. The control panel (not shown) consists of nine pushbutton switches and three indicator lights to control the various functions of cleaning the stud. There is also an interlock which prevents operation when the door 2a is not closed securely. This reduces the chance of personnel injury and contamination.

The preferred embodiment of the present invention have been disclosed for the purpose of illustration. Variations and modifications of the disclosed structure which fall within the concept of this invention will be readily apparent to persons skilled in tooling design. All such variations and modifications are intended to be encompassed by the claims set forth hereinafter.

We claim:

1. An apparatus for cleaning a rod-shaped object, comprising:

a coupling device for coupling to the rod-shaped object;

a support frame for supporting said coupling device so that an axis of the rod-shaped object is vertical;

an elevator system comprising a housing having an opening through which the rod-shaped object can pass and an elevator drive mechanism for displacing said housing along said vertical axis;

a brush assembly rotatably mounted to said housing for rotation about said vertical axis and having an opening through which the rod-shaped object can pass, said brush assembly comprising a brush having at least a portion which extends in said opening of said brush assembly; and a brush rotation drive mechanism for rotating said brush assembly about said vertical axis.

2. The apparatus as defined in claim 1, wherein said elevator drive mechanism and said brush rotation drive mechanism are operable concurrently to cause said brush assembly to rotate while said housing displaces.

3. The apparatus as defined in claim 1, wherein said elevator drive mechanism comprises:

first and second nuts coupled to said housing; and first and second lead screws rotatably mounted in said support frame and threadably coupled to said first and second nuts respectively.

4. The apparatus as defined in claim 3, wherein said elevator drive mechanism further comprises an air-powered motor and a plurality of gears for coupling said air-powered motor to said first and second lead screws so that said first and second lead screws rotate in unison in response to activation of said air-powered motor.

5. The apparatus as defined in claim 3, wherein said elevator drive mechanism further comprises first and second pivot pins which respectively pivotably couple said first and second nuts to said housing.

6. The apparatus as defined in claim 1, wherein said brush rotation drive mechanism comprises a ring gear rotatably mounted in said housing and connected to said brush assembly.

7. The apparatus as defined in claim 6, wherein said brush rotation drive mechanism further comprises an air-powered motor and a gear for coupling said air-powered motor to said ring so that said ring gear rotates in response to activation of said air-powered motor.

8. The apparatus as defined in claim 1, wherein said elevator drive means has first and second operational states, said elevator drive means causing said housing to ascend in said first operational state and said elevator drive means causing said housing to descend in said second operational state.

9. The apparatus as defined in claim 1, further comprising:

a fixed structure connected to said support frame;

a bellows having one end coupled to said housing and another end coupled to said fixed structure so that said bellows expands when said housing ascends and said bellows contracts when said housing descends; and a conduit having one end in flow communication with a volume inside said bellows and another end in flow communication with a volume outside said bellows.

10. An apparatus for cleaning a rod-shaped object having a longitudinal axis, comprising:

a housing having an opening with a centerline axis, said opening being dimensioned and shaped to allow the rod-shaped object to pass through when the centerline axis and the longitudinal axis are coaxial;

means for supporting the rod-shaped object so that the centerline axis and the longitudinal axis are coaxial;

a displacement drive mechanism for displacing said housing along said centerline axis;

a brush assembly rotatably mounted to said housing for rotation about said centerline axis and having an opening through which the rod-shaped object can pass when the centerline axis and the longitudinal axis are coaxial, said brush assembly comprising a brush having at least a portion which extends in said opening of said brush assembly; and a brush rotation drive mechanism for rotating said brush assembly about said centerline axis.

11. The apparatus as defined in claim 10, wherein said displacement drive mechanism and said brush rotation drive mechanism are operable concurrently to cause said brush assembly to rotate while said housing displaces.

12. The apparatus as defined in claim 10, wherein said displacement drive mechanism comprises:

first and second nuts coupled to said housing; and first and second lead screws rotatably mounted in said supporting means and threadably coupled to said first and second nuts respectively.

13. The apparatus as defined in claim 12, wherein said displacement drive mechanism further comprises an air-powered motor and a plurality of gears for coupling said air-powered motor to said first and second lead screws so that said first and second lead screws rotate in unison in response to activation of said air-powered motor.

14. The apparatus as defined in claim 12, wherein said displacement drive mechanism further comprises first and second pivot pins which respectively pivotably couple said first and second nuts to said housing.

15. The apparatus as defined in claim 10, wherein said brush rotation drive mechanism comprises a ring gear rotatably mounted in said housing and connected to said brush assembly.

16. The apparatus as defined in claim 15, wherein said brush rotation drive mechanism further comprises an air-powered motor and a gear for coupling said air-powered motor to said ring so that said ring gear rotates in response to activation of said air-powered motor.

17. The apparatus as defined in claim 10, wherein said brush assembly comprises a plurality of brushes, each brush comprising a multiplicity of bristles, and means for supporting said plurality of brushes in a circumferential array so that said bristles are directed generally radially inward toward said centerline axis.

18. The apparatus as defined in claim 10, further comprising:

an anchoring structure having a position which is fixed relative to said supporting means;

a bellows having one end coupled to said housing and another end coupled to said anchoring structure so that said bellows expands when said housing displaces in a first direction and said bellows contracts when said housing displaces in a second direction opposite to said first direction; and a conduit having one end in flow communication with a volume inside said bellows and another end in flow communication with a volume outside said bellows.

* * * * *